US009557121B2

(12) United States Patent
Park et al.

(10) Patent No.: US 9,557,121 B2
(45) Date of Patent: Jan. 31, 2017

(54) HEAT EXCHANGER

(71) Applicant: LG Electronics Inc., Seoul (KR)

(72) Inventors: Taegyun Park, Seoul (KR); Sehyeon Kim, Seoul (KR); Seungmo Jung, Seoul (KR); Eungyul Lee, Seoul (KR); Sanghoon Yoo, Seoul (KR); Naehyun Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 708 days.

(21) Appl. No.: 13/874,933

(22) Filed: May 1, 2013

(65) Prior Publication Data

US 2013/0292104 A1 Nov. 7, 2013

(30) Foreign Application Priority Data

May 4, 2012 (KR) ..... 10-2012-0047565

(51) Int. Cl.

| | |
|---|---|
| ***F28F 9/04*** | (2006.01) |
| ***F28F 9/02*** | (2006.01) |
| ***F28D 1/053*** | (2006.01) |
| *F28F 1/32* | (2006.01) |
| *F28D 21/00* | (2006.01) |

(52) U.S. Cl.

CPC ..... *F28F 9/02* (2013.01); *F28D 1/05391* (2013.01); *F28F 9/0204* (2013.01); *F28F 9/0268* (2013.01); *F28F 9/0278* (2013.01); *F28D 2021/0068* (2013.01); *F28F 1/32* (2013.01); *F28F 9/0207* (2013.01)

(58) Field of Classification Search

CPC ..... F28F 9/0204; F28F 9/0207; F28F 9/0217

USPC ..... 165/174; 62/525

See application file for complete search history.

(56) References Cited

U.S. PATENT DOCUMENTS

| | | | | |
|---|---|---|---|---|
| 5,934,367 | A * | 8/1999 | Shimmura et al. | F25B 39/028 165/153 |
| 6,082,448 | A * | 7/2000 | Haussmann | F28D 1/05391 165/158 |
| 7,775,263 | B2 * | 8/2010 | Han | F28D 1/05366 165/144 |
| 2008/0023185 | A1 * | 1/2008 | Beamer | F28D 1/05375 165/174 |
| 2009/0120627 | A1 | 5/2009 | Beamer et al. | |
| 2011/0139421 | A1 * | 6/2011 | Coyle | F28D 1/05391 165/173 |
| 2011/0220336 | A1 * | 9/2011 | Saito | F28D 1/05391 165/173 |

(Continued)

FOREIGN PATENT DOCUMENTS

| | | | |
|---|---|---|---|
| CN | 1781009 | A | 5/2006 |
| CN | 101558277 | A | 10/2009 |

(Continued)

*Primary Examiner* — Allen Flanigan

(74) *Attorney, Agent, or Firm* — Dentons US LLP

(57) ABSTRACT

Provided is a heat exchanger. The heat exchanger includes a plurality of refrigerant tubes in which a refrigerant flows, a heat dissipation-fin in which the plurality of refrigerant tubes are inserted and through which the refrigerant and a fluid are heat-exchanged with each other, a header coupled to at least one side of the plurality of refrigerant tubes to define a refrigerant flow space, and a guide device disposed within the header to branch the refrigerant into a plurality of passages corresponding to the plurality of refrigerant tubes.

4 Claims, 17 Drawing Sheets

(56) References Cited

U.S. PATENT DOCUMENTS

| | | | | |
|---|---|---|---|---|
| 2011/0303401 | A1* | 12/2011 | Kamoshida ..... | B60H 1/00335<br>165/173 |
| 2012/0096894 | A1* | 4/2012 | Higashiyama ..... | F25B 39/02<br>62/525 |

FOREIGN PATENT DOCUMENTS

| | | | |
|---|---|---|---|
| EP | 1857763 | A2 | 11/2007 |
| JP | 09-014885 | A | 1/1991 |
| JP | 03-195872 | A | 8/1991 |
| JP | 09-264693 | A | 10/1997 |
| JP | 11-201685 | A | 7/1999 |
| JP | 11-351782 | A | 12/1999 |
| JP | 2007-101158 | A | 4/2007 |
| JP | 2009-097838 | A | 5/2009 |
| JP | 2011-099649 | A | 5/2011 |

* cited by examiner

-RELATED ART-

-RELATED ART-

HEAT EXCHANGER

CROSS-REFERENCE TO RELATED APPLICATIONS

The present application claims priority under 35 U.S.C. 119 and 35 U.S.C. 365 to Korean Patent Application No. 10-2012-0047565 (filed on May 4, 2012), which is hereby incorporated by reference in its entirety.

BACKGROUND

The present disclosure relates to a heat exchanger.

In general, a heat exchanger is a part that is used in a heat-exchanging cycle. The heat exchanger may serve as a condenser or evaporator to heat-exchange a refrigerant flowing therein with an external fluid.

The heat exchanger may be largely classified into a fin-and-tube type and a micro channel type according to a shape thereof. The fin-and-tube type heat exchanger includes a plurality of fins and a tube having a circular shape or shapes similar to the circular shape and passing through the plurality of fins. The micro channel type heat exchanger includes a plurality of flat tubes through which a refrigerant flows and fins disposed between the plurality of flat tubes. In all of the pin-and-tube type heat exchanger and the micro channel type heat exchanger, a refrigerant flowing into the tube or flat tubes is heat-exchanged with an external fluid. Also, the fins may increase a heat exchange area between the refrigerant flowing into the tube or flat tubes and the external fluid.

Referring to FIG. 16, the micro channel type heat exchanger 1 according to the related art includes headers 2 and 3 coupled to a plurality of flat tubes 4. Hereinafter, a heat exchanger 1 that serves as an evaporator will be described as an example.

The headers 2 and 3 are provided in plurality. The first header 2 of the plurality of headers 2 and 3 is coupled to one side of the plurality of flat tubes 4, and the second header 3 is coupled to the other side of the plurality of flat tubes 4. Also, a heatsink fin 5 for easily heat-exchanging a refrigerant with external air is disposed between the plurality of flat tubes 4.

The first header 2 includes a refrigerant inflow part through which the refrigerant is introduced into the heat exchanger 1 and a refrigerant discharge part 7 through which the refrigerant heat-exchanged within the heat exchanger 1 is discharged. Also, a baffle 8 for guiding a flow of the refrigerant is provided within the first and second headers 2 and 3. The flow of the refrigerant within the first or second header 2 or 3 may be guided into the flat tubes 4 by the baffle 8.

The refrigerant introduced into the heat exchanger 1 may have a two-phase state. On the other hand, the refrigerant just before being discharged from the heat exchanger 1 may be a gaseous refrigerant or a refrigerant having a very high dryness degree. Thus, a flow rate of refrigerant to be discharged from the heat exchanger 1 may be relatively greater than that of refrigerant to be introduced into the heat exchanger 1.

Thus, the refrigerant may be concentrated into an outlet-side of the heat exchanger at which a flow rate of the refrigerant is relatively high. Particularly, when the header coupled to at least one side of the flat tubes 4 is vertically disposed, the gravity may acts on the refrigerant within the header to concentrate the refrigerant into the flat tube disposed at a lower portion of the outlet-side of the heat exchanger.

Also, as shown in FIG. 17, liquid and gaseous refrigerants flowing into the header 3 are partitioned as separate layers. That is, a liquid layer 3*a* and a gaseous layer 3*b* within the header 3 may be partitioned vertically or horizontally.

Also, since the liquid layer 3*a* may be formed with a thick thickness along an inner surface of the header 3, the refrigerant may not be uniformly distributed into the flat tubes 4. In addition, the liquid refrigerant may be introduced into one flat tube of the plurality of flat tubes, and the gaseous refrigerant may be introduced into the other flat tube.

As a result, an amount of refrigerant flowing into one flat tube of the plurality of flat tubes may be different from that of refrigerant flowing into the other flat tube to reduce heat-exchange efficiency.

SUMMARY

Embodiments provide a heat exchanger which is capable of uniformly distributing a refrigerant into a plurality of flat tubes.

In one embodiment, a heat exchanger includes: a plurality of refrigerant tubes in which a refrigerant flows; a heat dissipation-fin in which the plurality of refrigerant tubes are inserted and through which the refrigerant and a fluid are heat-exchanged with each other; a header coupled to at least one side of the plurality of refrigerant tubes to define a refrigerant flow space; and a guide device disposed within the header to branch the refrigerant into a plurality of passages corresponding to the plurality of refrigerant tubes.

In another embodiment, a heat exchanger includes: a plurality of flat tubes in which a refrigerant flows, the plurality of flat tubes being arranged in a vertical direction; a header coupled to one sides of the plurality of flat tubes to guide the refrigerant into the plurality of flat tubes; and a guide device disposed in at least one region within the header, wherein the guide device includes: a plurality of guide parts distributing the refrigerant into a plurality of flow spaces; and a partition part coupled to one sides of the plurality of guide parts, the partition part having a communication hole through which the refrigerant flowing into the plurality of flow spaces flows into the flat tubes.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
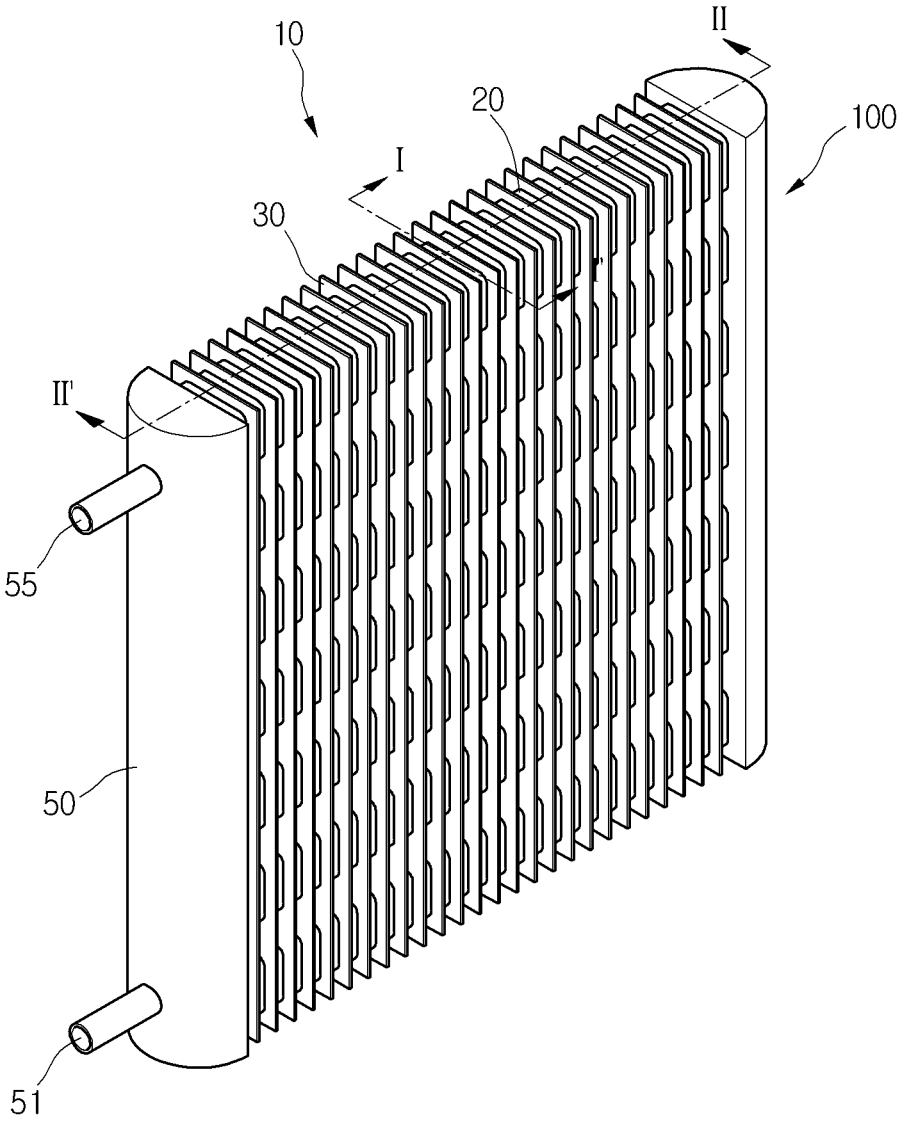
FIG. 1 is a perspective view of a heat exchanger according to a first embodiment.
Figure 2:
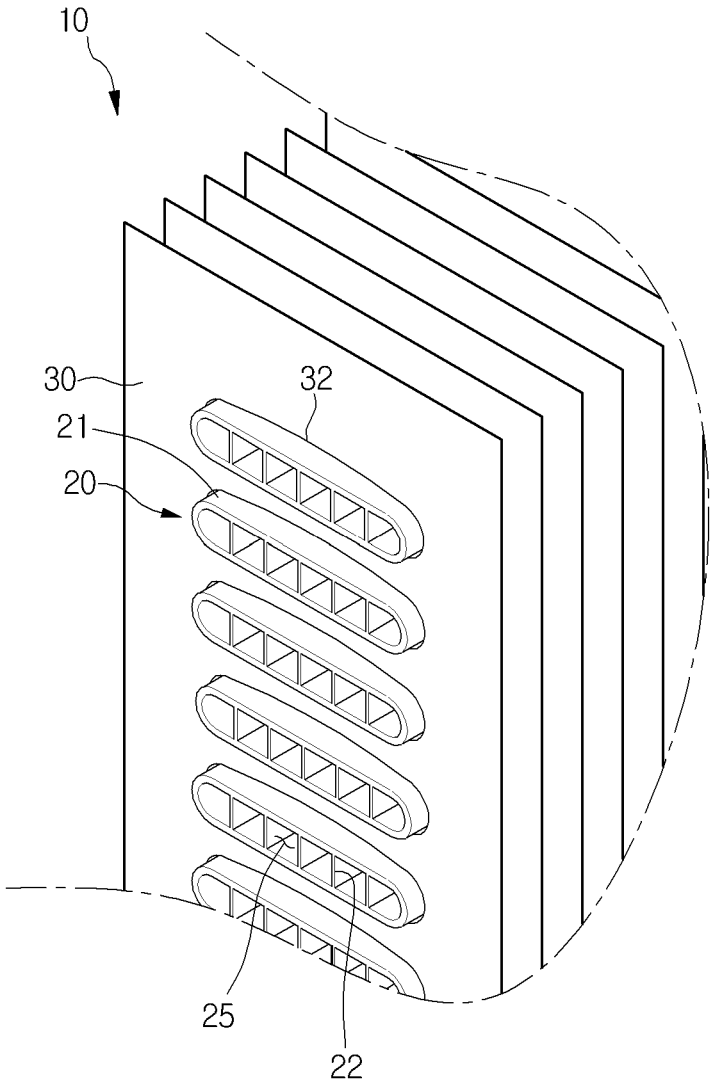
FIG. 2 is a cross-sectional view taken along line I-I' of FIG. 1.
Figure 3:
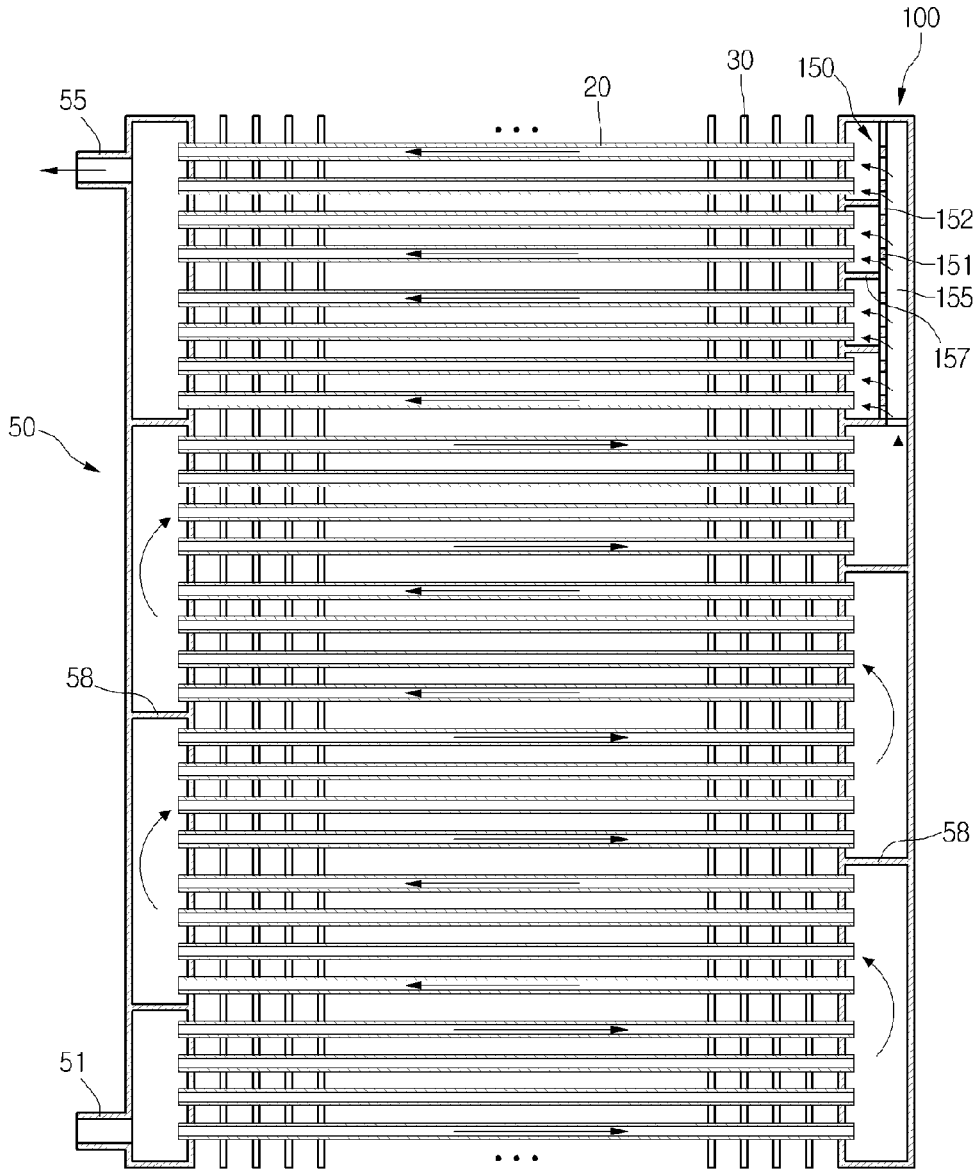
FIG. 3 is a cross-sectional view taken along line II-II' of FIG. 1.

FIG. 1 is a perspective view of a heat exchanger according to a first embodiment, FIG. 2 is a cross-sectional view taken along line I-I' of FIG. 1, and FIG. 3 is a cross-sectional view taken along line II-II' of FIG. 1.

Referring to FIGS. 1 to 3, a heat exchanger 10 according to a first embodiment includes headers 50 and 100 extending vertically by a predetermined length, a plurality of flat tubes 20 coupled to the headers 50 and 100 to extend horizontally, thereby serving as a refrigerant tube, and a plurality of heat-dissipation fins 30 arranged at a predetermined distance between the headers 50 and 100 and through which the flat tubes 20 pass. The headers 50 and 60 may be called "vertical type headers" in that each of the headers 50 and 60 extends in a vertical direction.

In detail, the headers 50 and 100 include a first header 50 including a refrigerant inflow part 51 through which a refrigerant is introduced into the heat exchanger 10 and a refrigerant discharge part 55 through which the refrigerant heat-exchanged within the heat exchanger 10 is discharged and a second header 100 spaced apart from the first header 50. An end of one side of each of plurality of flat tubes 20 may be coupled to the first header 50, and an end of the other side of each of the plurality of flat tubes 20 may be coupled to the second header 100.

A flow space of the refrigerant is defined within each of the first and second headers 50 and 100. The refrigerant within the first or second header 50 or 100 may be introduced into the flat tubes 20, and a flow direction of the refrigerant flowing into the flat tubes 20 may be switched within the first or second header 50 or 100.

For example, the refrigerant flowing in a left direction through the flat tubes 20 may be switched in flow direction within the first header 50 to flow in a right direction. Also, the refrigerant flowing in a right direction through the flat tubes 20 may be switched in flow direction within the second header 100 to flow in a left direction (see FIG. 3). Thus, the first or second header 50 or 100 may be called a "return header".

The refrigerant inflow part 51 may be disposed in a lower portion of the first header 50, and the refrigerant discharge part 55 may be disposed in an upper portion of the first header 50. The refrigerant introduced through the refrigerant inflow part 51 is circulated into the flat tubes 20 to flow in a direction opposite to the gravity. Then, the refrigerant may be discharged through the refrigerant discharge part 55. That is, the refrigerant may flow upward from the refrigerant inflow part 51 toward the refrigerant discharge part 55.

For example, when the heat exchanger 10 serves as the evaporator, the refrigerant introduced into the refrigerant inflow part 51 may be a liquid refrigerant or a two-phase refrigerant having a low dryness degree. Also, the refrigerant discharged through the refrigerant discharge part 55 may be a gaseous refrigerant or a two-phase refrigerant having a high dryness degree. Thus, the refrigerant may increase in density and specific volume while passing through the heat exchanger 10, and thus, the refrigerant may easily flow upward.

The flat tubes 20 may be provided in plurality between the first header 50 and the second header 100. The plurality of flat tubes 20 may be spaced apart from each other in a vertical direction.

Each of the flat tubes 20 includes a tube body 21 defining an outer appearance thereof and a partition rib 22 for defining a plurality of micro channels 25 within the tube body 10. The refrigerant introduced into the flat tubes 20 may be uniformly distributed into the plurality of micro channels 25 to flow. Also, heat-dissipation fins 30 have through holes 32 through which the plurality of flat tubes 20 pass.

A baffle 58 for guiding the refrigerant to flow into the first header 50, the flat tubes 20, and the second header 60 in a zigzag shape is disposed within the first or second header 50 or 100. The baffle 58 may be disposed to partition an inner space of the first or second header 50 or 100 into upper and lower spaces.

A channel of the refrigerant flowing along the flat tubes 20 may be provided as a meander line having an S shape by the baffle 58. Since the channel of the refrigerant flowing along the flat tubes 20 is provided as the meander line, a contact area and time between the refrigerant and air may increases to improve heat exchange efficiency.

In summary, the inner space of the first or second header 50 or 100 may be partitioned into a plurality of spaces by the baffle 58. Here, each of the partitioned spaces may be understood as a space part that allows the refrigerant to flow into the flat tubes 20.

A guide device 150 for guiding the refrigerant flowing into the second header 100 toward the flat tube 20 is disposed within the second header 100.

The guide device 150 includes a partition part 151 for partitioning an inner space of the second header 100. For example, the partition part 151 vertically extends to horizontally partition the inner space of the second header 100.

The guide device 150 further includes a guide part 155 disposed on one side of the partition part 151 to distribute a refrigerant into a plurality of flow passages and a plurality of partition walls 157 disposed on the other side of the partition part 151 to guide a refrigerant so that the refrigerant flows into at least one flat tube 20.

Each of the partition walls 157 extends from the partition part 151 in a direction of the flat tubes 20, and the guide part 155 extends from the partition part 151 in a direction opposite to the flat tubes 20. Each of the partition wall 157 and the guide part 155 may be provided in plurality.

A communication hole 152 through which the refrigerant flowing along the guide part 155 passes through the partition part 151 is defined in the partition part 151. The communication hole 152 may be provided in plurality to correspond to position or heights of the flat tubes 20. When the refrigerant flows upward along the guide part 155, a portion of the refrigerant is introduced into the flat tubes 20 through the communication hole 152.

The plurality of communication holes 152 may be defined between one partition wall of the plurality of partition walls 157 and the other partition wall adjacent to the one partition wall.

The guide device 150 may be disposed in the uppermost space of the spaces partitioned by the baffle 58. For example, the guide device 150 may be disposed at a position corresponding to the refrigerant discharge part 55.

On the other hand, it may be understood that the guide device 150 is disposed on a channel closer to the refrigerant discharge part 55 than the refrigerant inflow part 51 among the whole channels of the refrigerant flowing into the heat exchanger from the refrigerant inflow part 51 to the refrigerant discharge part 55. Thus, the gaseous refrigerant having a high flow rate or the two-phase refrigerant a high dryness degree may be guided by the guide device 150 and uniformly distributed into the plurality of flat tubes 20.

Alternatively, the guide device 150 may be vertically provided in plurality within the second header 100. For example, the guide device 150 may be further disposed in a lower or middle portion of the second header 100.

A flow of a refrigerant according to the current embodiment will be described with reference to FIG. 3.

A refrigerant is introduced through the refrigerant inflow part 51 to flow into the plurality of flat tubes 20 (a right direction in FIG. 3). An upstream flow of the refrigerant above a predetermined height may be restricted by the baffle 58 disposed above the refrigerant inflow part 51. The refrigerant passing through the flat tubes 20 flows upward within the second header 100. Then, a flow direction of the refrigerant may be switched to flow in a left direction. An upstream flow of the refrigerant above a predetermined height may be restricted by the baffle 58 disposed in the second header 100.

Also, a flow direction of the refrigerant passing through the flat tubes 20 may be switched again within the first header 50 to flow into the flat tubes 20. The above-described circulation process (a flow in a left or right direction) may be repeatedly performed. Also, as described above, the circulation process of the refrigerant may be easily performed by the baffle 58. Also, the refrigerant may be introduced through the refrigerant inflow part 51 to circulate into the flat tubes 20. Then, the refrigerant may flow upward toward the refrigerant discharge part 55, i.e., in a direction opposite to the gravity.

In the above-described refrigerant circulation process, when the refrigerant reaches an upper portion of the second header 100, the refrigerant flows upward along the guide device 150. Also, the refrigerant may be branched into a plurality of passages by the guide part 155 to flow.

Then, the refrigerant may flow from one side of the partition part 151 to the other side through the communication hole 152 to flow into the flat tubes 20. When the refrigerant passes through the flat tubes 20, the refrigerant is introduced into the first header 50, and then is discharged to the outside of the heat exchanger 10 through the refrigerant discharge part 55.

Hereinafter, the second header according to the first embodiment will be described with reference to the accompanying drawings. Hereinafter, the second header will be referred to as a "header'.

Figure 4:
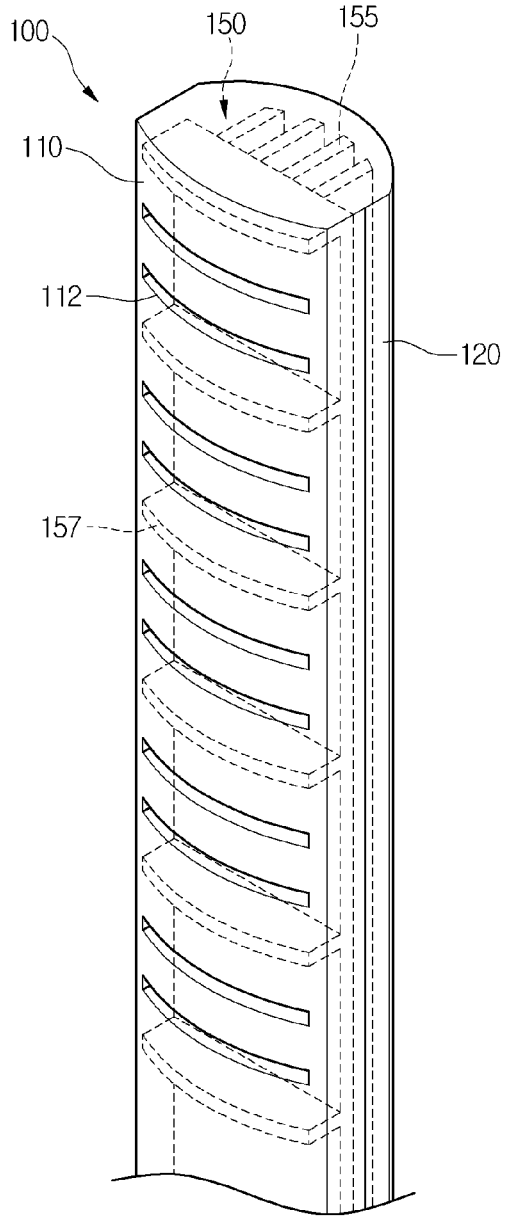
FIG. 4 is a perspective view of a header according to the first embodiment.
Figure 5:
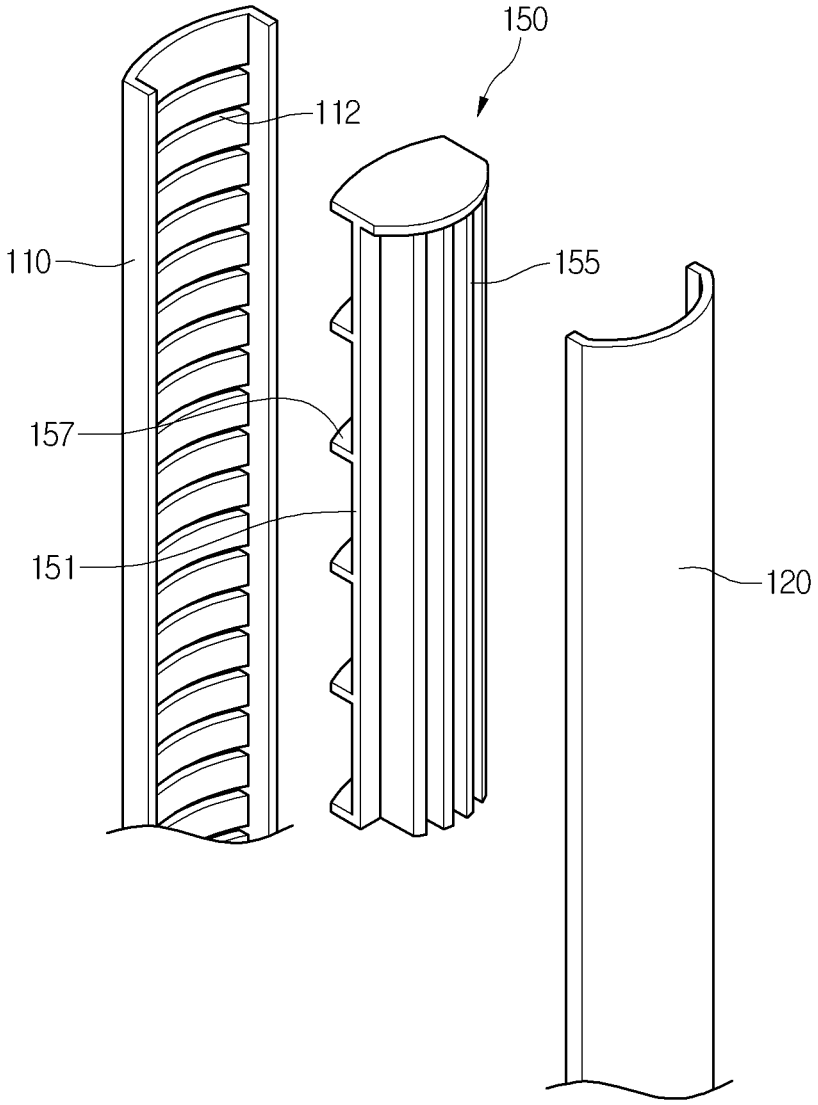
FIG. 5 is an exploded perspective view of the header according to the first embodiment.

FIG. 4 is a perspective view of a header according to the first embodiment, and FIG. 5 is an exploded perspective view of the header according to the first embodiment.

Referring to FIGS. 4 and 5, the header 100 according to the current embodiment includes a header body 110 coupled to the flat tubes 20, a header cover coupled to one side of the header body 110, and a guide device 150 coupled to the insides of the header body 110 and the header cover 120. The header body 110 and the header cover 120 may be integrated with each other. Alternatively, the header body 110 and the header cover 120 may be provided as separate parts, and then be coupled to each other.

In detail, the header body 110, the header cover 120, and the guide device 150 may be integrated with each other through brazing welding. That is, a welding agent (for example, clad) may be provided on at least one portion of the header body 110, the header cover 120, and the guide device 150 to couple or assemble the header body 110, the header cover 120, and the guide device 150 to each other. In this state, the header body 110, the header cover 120, and the guide device 150 which are coupled to or assembled with each other may be heated within a normal blazing furnace and be welded.

As described above, since the header body 110, the header cover 120, and the guide device 150 are integrated with each other through the brazing welding, the header 100 may be firmly maintained. Thus, since a separate coupling member is not necessary, a process for manufacturing the header 100 may be simplified, and manufacturing costs may be reduced.

A tube coupling part 112 to which the plurality of flat tubes 20 are coupled is disposed in the header body 110. The tube coupling part 112 may be formed by cutting at least one portion of the header body 110. Also, the tube coupling part 112 may be provided in plurality to correspond to the positions of the plurality of flat tubes 20.

The guide device 150 includes the partition part 151 extending in a length direction of the guide device 150, the plurality of partition walls 157 coupled to one side of the partition part 151 and spaced apart from each other, and the guide part 155 coupled to the other side of the partition part 151 to extend in a length direction along the partition part 151.

The plurality of partition walls 157 are coupled to the inside of the header body 110. Also, the plurality of partition walls 157 are spaced apart from each other at substantially the same distance. The tube coupling part 112 having a preset number may be disposed between one partition wall and the other partition wall adjacent to the one partition wall. For example, as shown in FIG. 4, the preset number may be two.

A refrigerant flowing between the one partition wall and the other partition wall is guided to flow into the tuber coupling part 112 having the preset number. Thus, a flow of the refrigerant along the length direction of the header 100 by passing through the one partition wall or the other partition wall may be restricted.

The guide part 155 may be provided in plurality, and the plurality of guide parts 155 may be spaced apart from each other. Also, the guide part 155 may extend along a flow direction of the refrigerant, i.e., parallel to the flow direction of the refrigerant. That is, in a state where the header 100 is coupled to the heat exchanger 10, the guide part 155 may extend in a vertical direction. Thus, the guide part 155 may distribute the refrigerant in a horizontal direction with respect to the flow direction of the refrigerant.

The guide part 155 may extend from the partition part 151 and be coupled to an inner surface of the header body 110 or the header cover 120. Also, to effectively distribute the refrigerant, the plurality of guide parts 155 may extend parallel to each other (see FIG. 8).

Figure 6:
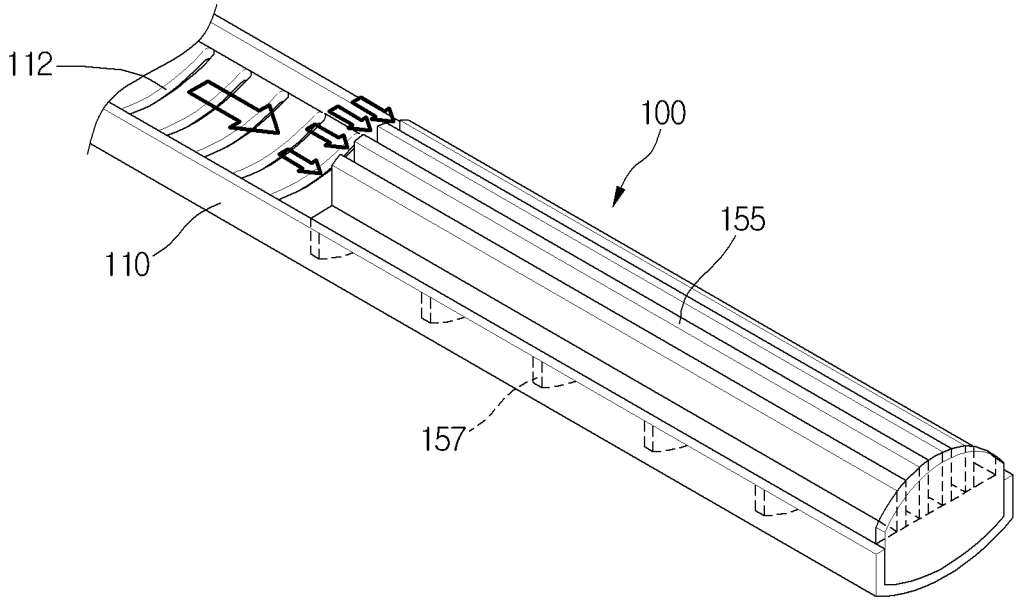
FIGS. 6 and 7 are views illustrating a flow state of a refrigerant within a portion of the header according to the first embodiment.
Figure 7:
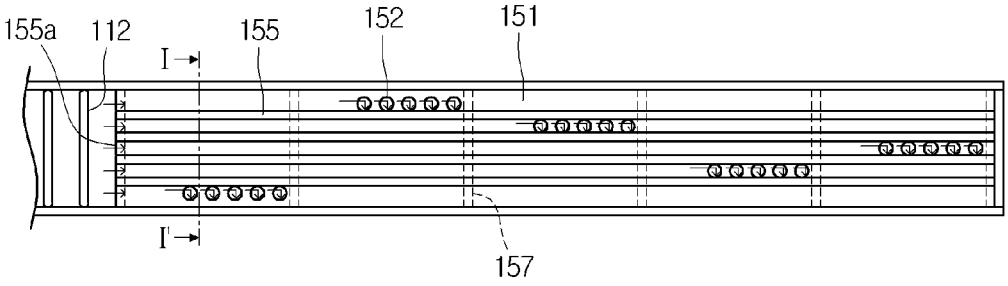
Figure 8:
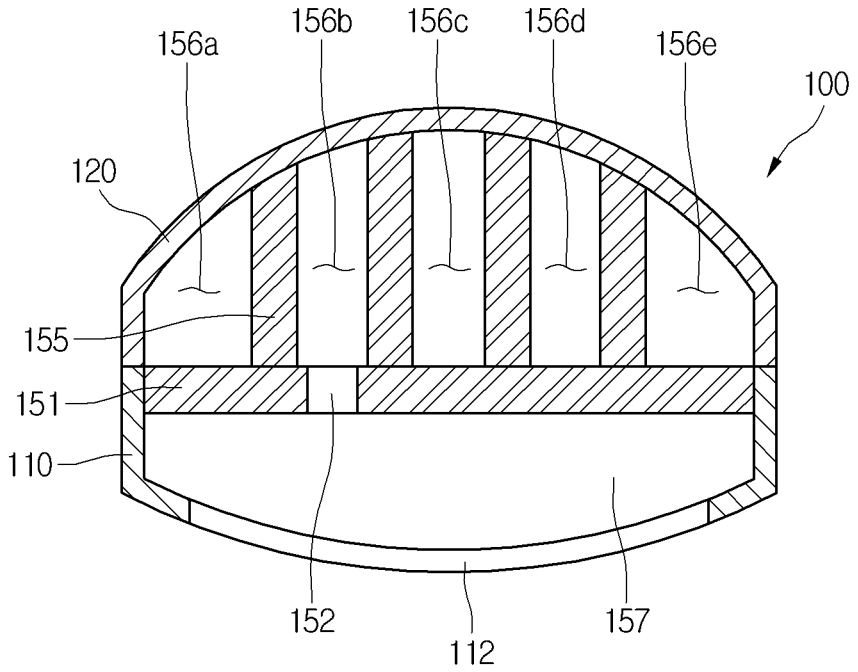
FIG. 8 is a cross-sectional view taken along line I-I' of FIG. 7.
Figure 9:
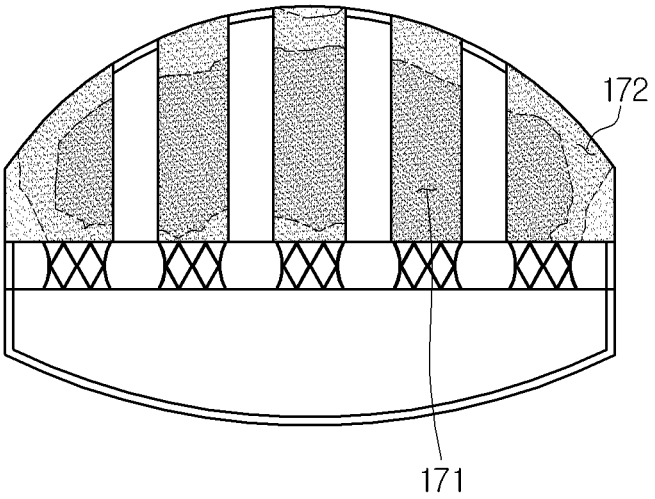
FIG. 9 is a view illustrating a result obtained by simulating a refrigerant flow according to the header of the FIG. 8.

FIGS. 6 and 7 are views illustrating a flow state of a refrigerant within a portion of the header according to the first embodiment, FIG. 8 is a cross-sectional view taken along line I-I' of FIG. 7, and FIG. 9 is a view illustrating a result obtained by simulating a refrigerant flow according to the header of the FIG. 8.

Referring to FIG. 6, a refrigerant flows into the header 100 according to the first embodiment. The refrigerant may flow from the header 100 into the plurality of flat tubes 20.

When the refrigerant reaches the guide device 150 while flowing into the header 100, the refrigerant is branched into a plurality of passage in a guide inflow part 155*a*. For example, the refrigerant may be horizontally spread with respect to a flow direction thereof by the guide inflow part 155*a* to flow into the guide part 155. Thus, when the refrigerant is branched into the plurality of passages, the refrigerant may not be concentrated into a portion of a space, but be uniformly distributed into the whole space.

Referring to FIG. 8, each of the guide parts 155 extends from the partition part 151 and is coupled to the inside of the header cover 120. Thus, a plurality of flow spaces 156*a*, 156*b*, 156*c*, 156*d*, and 156*e* partitioned by the guide parts 155 may be defined inside the header 100.

The plurality of flow spaces 156*a*, 156*b*, 156*c*, 156*d*, and 156*e* may be horizontally partitioned with respect to the flow direction of the refrigerant.

Also, the communication hole 152 through which the refrigerant flows from the flow spaces 156*a*, 156*b*, 156*c*, 156*d*, and 156*e* toward the partition wall 157 is defined in a lower portion (in FIG. 8) of each of the flow spaces 156*a*, 156*b*, 156*c*, 156*d*, and 156*e*. The communication hole 152 is defined in the partition part 151. The refrigerant within the flow spaces 156*a*, 156*b*, 156*c*, 156*d*, and 156*e* passes through the partition part 151 to flow into a side space of the partition part 151. Here, the side space represents a space defined in a side opposite to the flow spaces 156*a*, 156*b*, 156*c*, 156*d*, and 156*e* with respect to the partition part 151.

The partition wall 157 includes a plurality of partition walls partitioning the side space of the partition part 151. The plurality of partition walls includes a first partition wall 157*a*, a second partition wall 157*b*, and a third partition wall 157*c*.

As described above, the plurality of partition walls are spaced apart from each other with substantially the same distance. The same number of tube coupling part 112 may be disposed between the adjacent two partition walls. Also, the communication hole 152 is defined to correspond to a space between the adjacent two partition walls.

Thus, the refrigerant flowing along each of the flow spaces 156*a*, 156*b*, 156*c*, 156*d*, and 156*e* is guided by the adjacent two partition walls while flowing through the communication hole 152. Then, the refrigerant may be introduced into the flat tubes via the space between the adjacent two partition walls.

For example, as shown in FIGS. 7 and 8, the refrigerant within the fifth flow space 156*e* of the refrigerant flowing along each of the flow spaces 156*a*, 156*b*, 156*c*, 156*d*, and 156*e* passes through the communication hole 151 first. Then, the refrigerant successively flows into the first flow space 156*a*, the second flow space 156*b*, the fourth flow space 156*d*, and the third flow space 156*c*.

That is, the communication holes 152 defined in the flow spaces 156*a*, 156*b*, 156*c*, 156*d*, and 156*e* may have different distances from the guide inflow part 155*a*. Thus, in a state where the refrigerant is branched into each of the flow spaces 156*a*, 156*b*, 156*c*, 156*d*, and 156*e*, the refrigerant may pass through the communication holes 152 at different time points. As a result, the refrigerants within the flow spaces 156*a*, 156*b*, 156*c*, 156*d*, and 156*e* may be introduced into the different flat tubes 20, respectively.

For example, as shown in FIG. 7, the refrigerant flowing into the third flow space 156*c* may be introduced into the upmost flat tube 20 of the heat exchanger 10 (see FIG. 3).

Since the refrigerant is smoothly distributed into the flow spaces 156*a*, 156*b*, 156*c*, 156*d*, and 156*e* within the header 100 by the above-described refrigerant flow, the refrigerant may be effectively distributed into the plurality of flat tubes 20.

Particularly, as shown in FIG. 9, when the refrigerant is introduced into the guide device 150, a liquid refrigerant and a gaseous refrigerant may be uniformly distributed into each of the flow spaces 156*a*, 156*b*, 156*c*, 156*d*, and 156*e* partitioned by the plurality of guide parts 155. In detail, a gaseous flow space 171 in which a gaseous refrigerant flows and a liquid flow space 172 in which a liquid refrigerant flows are defined in the header 100.

The liquid flow space 172 may be defined to surround the gaseous flow space 171. Thus, the refrigerant may flow along a relatively thin layer in a state where the refrigerant is adjacent to an inner surface of the header 100.

Figure 17:
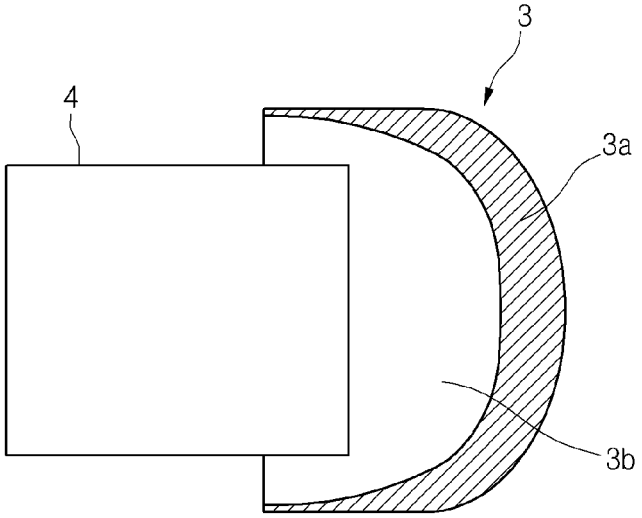
FIG. 17 is a view illustrating a flow state of a refrigerant within the heat exchanger according to the related art.

The above-described refrigerant flow may improve refrigerant distribution efficiency when compared to a refrigerant flow in a case where the guide part is not provided, i.e., a refrigerant flow (see FIG. 17) in a case where a liquid refrigerant forms a thick flow layer along the inner surface of the header, and the liquid refrigerant and the gaseous refrigerant are partitioned into upper and lower layers.

Hereinafter, a second embodiment will be described. The second embodiment is equal to the first embodiment except for a guide device. Thus, their different points may be mainly described, and also, the same parts as those of the first embodiment will be denoted by the same description and reference numeral.

Figure 10:
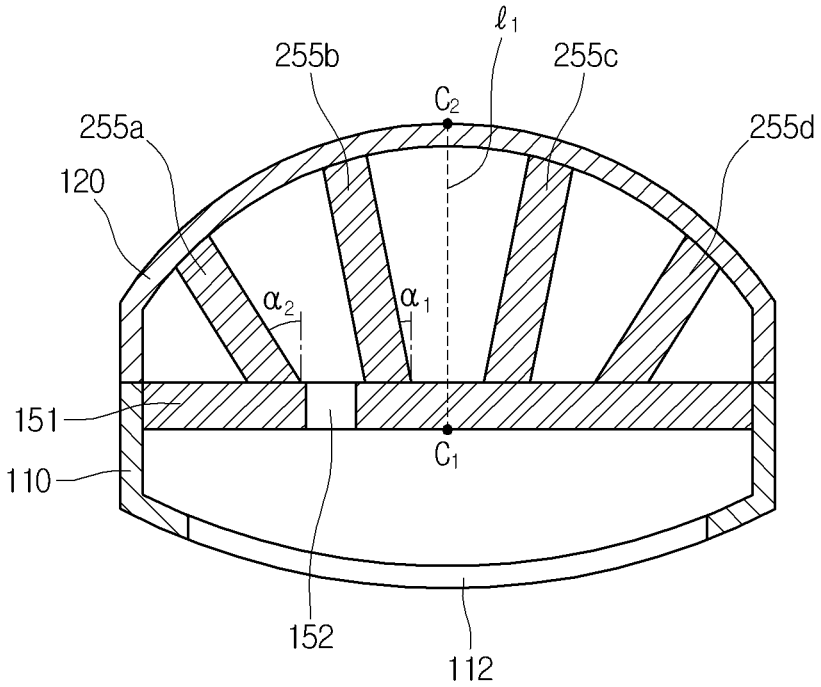
FIG. 10 is a cross-sectional view of a header according to a second embodiment.
Figure 11:
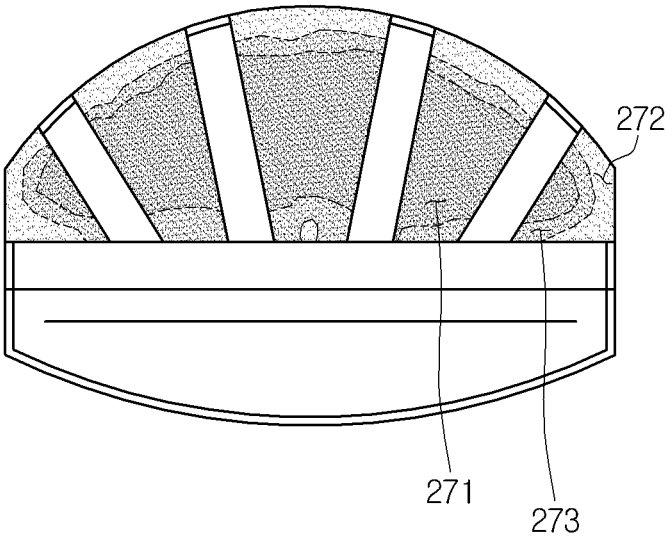
FIG. 11 is a view illustrating a result obtained by simulating a refrigerant flow according to the header of the FIG. 10.

FIG. 10 is a cross-sectional view of a header according to a second embodiment, and FIG. 11 is a view illustrating a result obtained by simulating a refrigerant flow according to the header of the FIG. 10.

Referring to FIG. 10, a guide device 150 according to a second embodiment includes a plurality of guide parts 255 radially extending from a partition part 151 toward a header cover 120. The plurality of guide parts 255 are coupled to an inner surface of the header cover 120. Thus, an inner space of the header 100 is partitioned into a plurality of flow spaces. Since this is similar to that described in the first embodiment, their detailed description will be omitted.

The plurality of guide parts 255 may be inclined outward with respect to a virtual center line l1 of the partition part 151. Here, the virtual center line l1 may represent a line extending linearly from a center portion C1 of the partition part 151 toward a center portion C2 of an outer surface of the header cover 120. That is, the virtual center line l1 may be called a vertical center line of the header 100.

The plurality of guide parts 255 include first and second guide part 255*a* and 255*b* provided at one side of the virtual center line l1 and third and fourth guide parts 255*c* and 255*d* provided at the other side of the virtual center line l1. Both sides of the plurality of guide parts 255 may be symmetric to each other with respect to the virtual center line l1.

The second guide part 255*b* is disposed between the first guide part 255*a* and the virtual center line l1, and the third part 255*c* is disposed between the virtual center line l1 and the fourth guide part 255*d*.

One guide part far away from the virtual center line l1 of the plurality of guide parts 255 may be further inclined outward than the other guide part adjacent to the virtual center line l1. That is, the guide part far spaced apart from the virtual center line l1 of the plurality of guide parts 255 may be further inclined outward than the guide part adjacent to the virtual center line l1.

For example, an angle $\alpha 2$ between the first guide part 255*a* and he virtual center line l1 is greater than that $\alpha 1$ between the second guide part 255*b* and the virtual center line l1.

Similarly, an angle between the fourth guide part 255*d* and the virtual center line l1 is greater than that between the third guide part 255*c* and the virtual center line l1. That is, as the plurality of guide parts 255 are far away from the virtual center line l1, the inclined angle may increase.

As described above, since the plurality of guide parts 255 are inclined outward from the center line of the header 100, and the inclined angle of the guide part far away from the center line is greater than that of the guide part adjacent to the center line, the refrigerant introduced into the guide device 250 may be uniformly distributed over the whole flow spaces of the header 100.

Particularly, as shown in FIG. 11, when the refrigerant is introduced into the guide device 250, a liquid refrigerant and a gaseous refrigerant may be uniformly distributed into the flow spaces partitioned by the plurality of guide parts. In detail, a gaseous flow space 271 in which the gaseous refrigerant flows, a liquid flow space 272 in which the liquid refrigerant flows, and a mixture flow space 273 in which a mixture of the gases and liquid refrigerants flows are defined in the header 100.

The mixture flow space 273 is defined to surround the gaseous flow space 271, and the liquid flow space 272 is defined to surround the mixture flow space 272. Also, since the refrigerant within the liquid flow space 272 is guided into an edge portion (a corner portion) of the header 100 by the inclined guide parts, the refrigerant may form a relatively thin layer in a state where the refrigerant is adjacent to an inner surface of the header 100 to flow.

The above-described refrigerant flow may improve refrigerant distribution efficiency when compared to a refrigerant flow in a case where the guide part is not provided, i.e., a refrigerant flow (see FIG. 17) in a case where a liquid refrigerant forms a thick flow layer along the inner surface of the header, and the liquid refrigerant and the gaseous refrigerant are partitioned into upper and lower layers.

Figure 12:
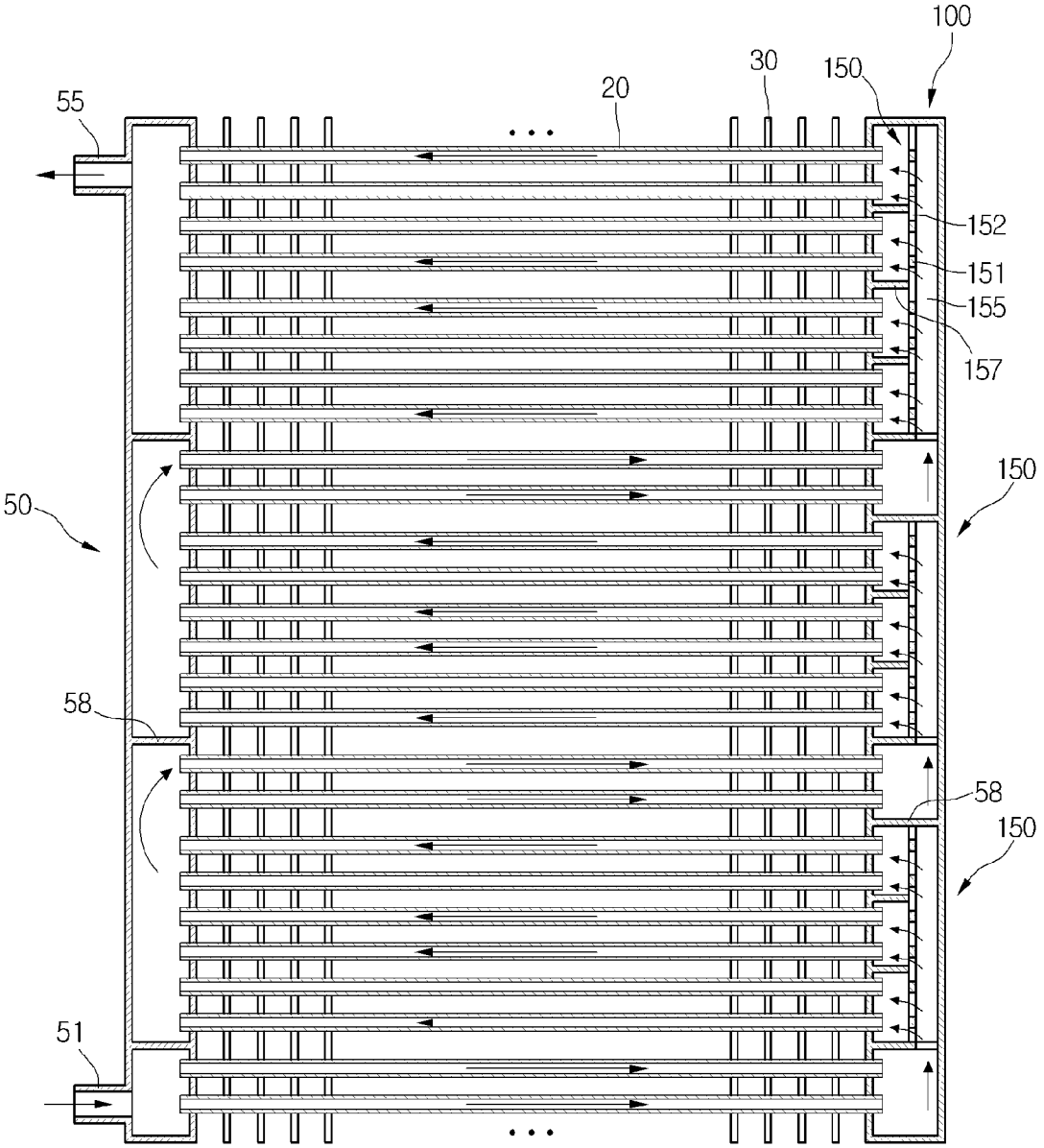
FIG. 12 is a cross-sectional view of a heat exchanger according to a third embodiment.

FIG. 12 is a cross-sectional view of a heat exchanger according to a third embodiment.

Referring to FIG. 12, a header 100 of a heat exchanger 10 according to a third embodiment includes a plurality of guide devices 150 arranged in a length direction of the header 100.

The plurality of guide devices 150 may be disposed to be spaced apart from each other from a lower end of the header 100 to an upper end of the header 100. In detail, the plurality of guide devices 150 may be vertically partitioned with respect to a baffle 58. Descriptions with respect to the guide devices 150 will be denoted by those of the first embodiment.

As shown in FIG. 12, since the plurality of guide devices 150 are provided within the header 100, it may prevent the refrigerant from being concentrated into one space within the header 100 over the whole length or region of the header 100. Also, since the refrigerant is distributed into each of the flow spaces in a state where the liquid and gases refrigerants are adequately mixed with each other, a two-phase refrigerant may be easily introduced into each of the flat tubes connected to the header 100.

In a vertical type header, the guide device 150 is disposed at the uppermost side of the header 100 in FIG. 3, and the plurality of guide devices 150 are provided over the whole region of the header 100 in FIG. 12.

However, on the other hand, the guide device 150 may be disposed at a middle or lower portion of the header 100. This will be easily understood by a person skilled in the art on the basis of the foregoing embodiments.

Another embodiment will be proposed.

Although the plurality of guide devices 150 are disposed along the whole length of the header 100 in FIG. 12, the present disclosure is not limited thereto. For example, one guide device 150 may be disposed along the whole length of the header 100. That is, one guide device 150 may extend from a lower end of the header 100 up to an upper end of the header 100.

Figure 13:
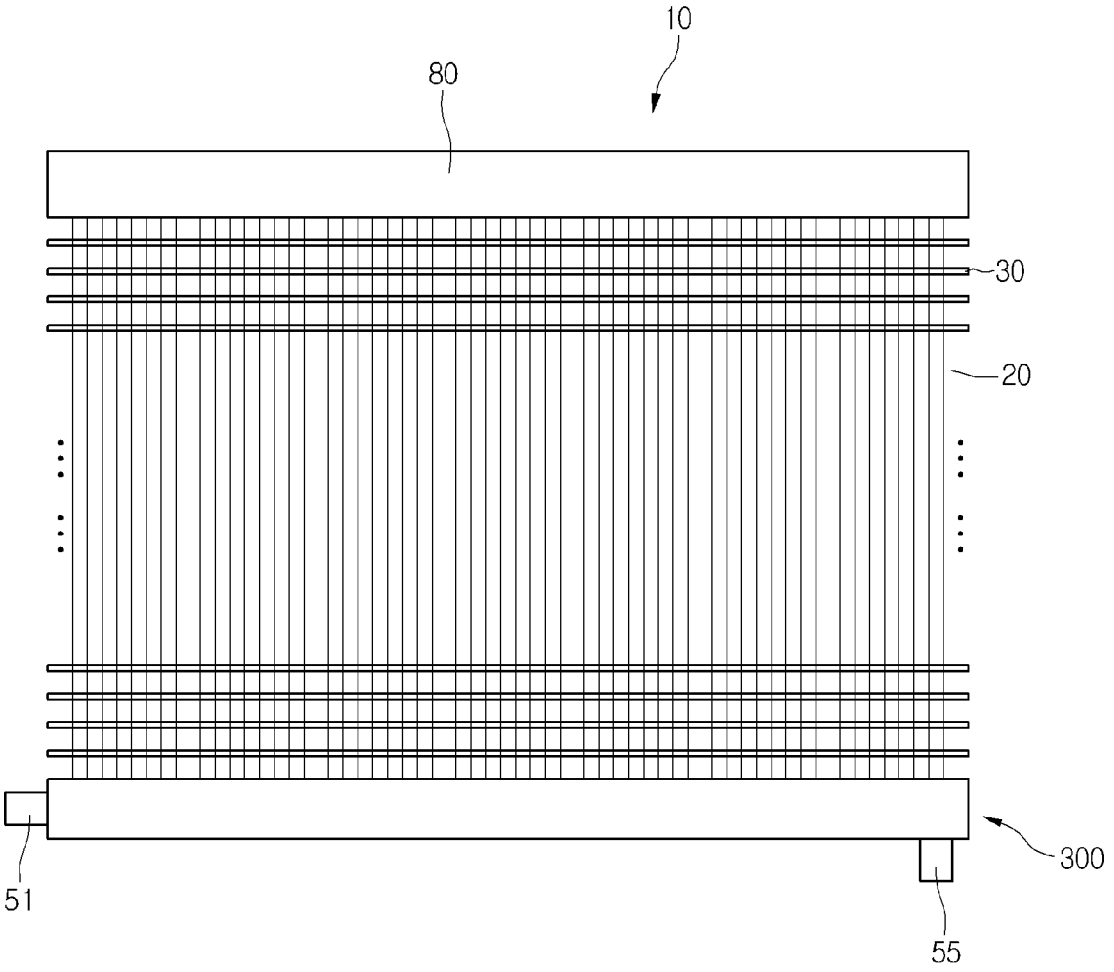
FIG. 13 is a front view of a heat exchanger according to a fourth embodiment.
Figure 14:
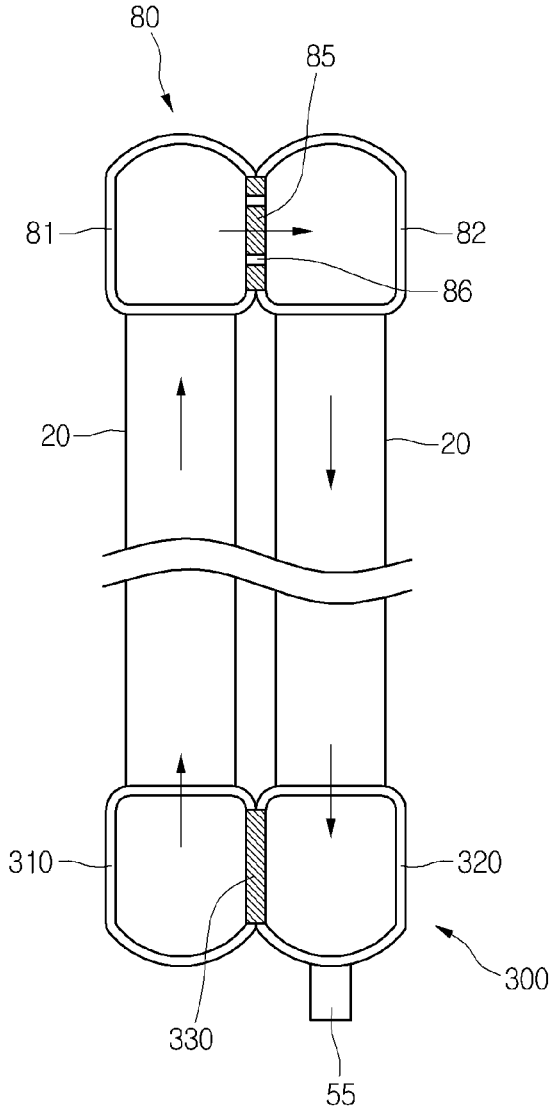
FIG. 14 is a side view of the heat exchanger according to the fourth embodiment.
Figure 15:
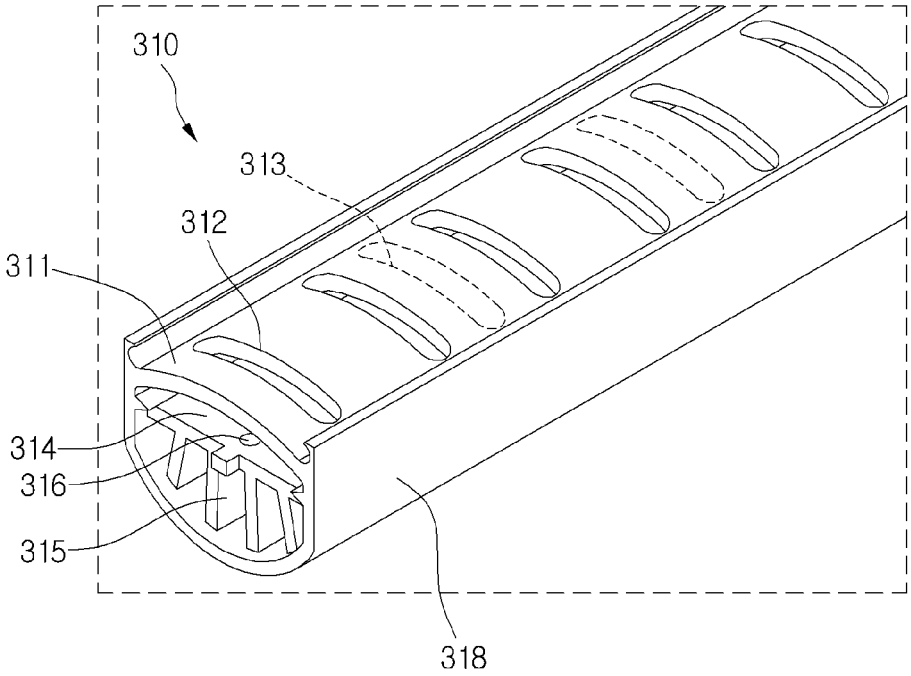
FIG. 15 is a perspective view of an inflow header according to the fourth embodiment.
Figure 16:
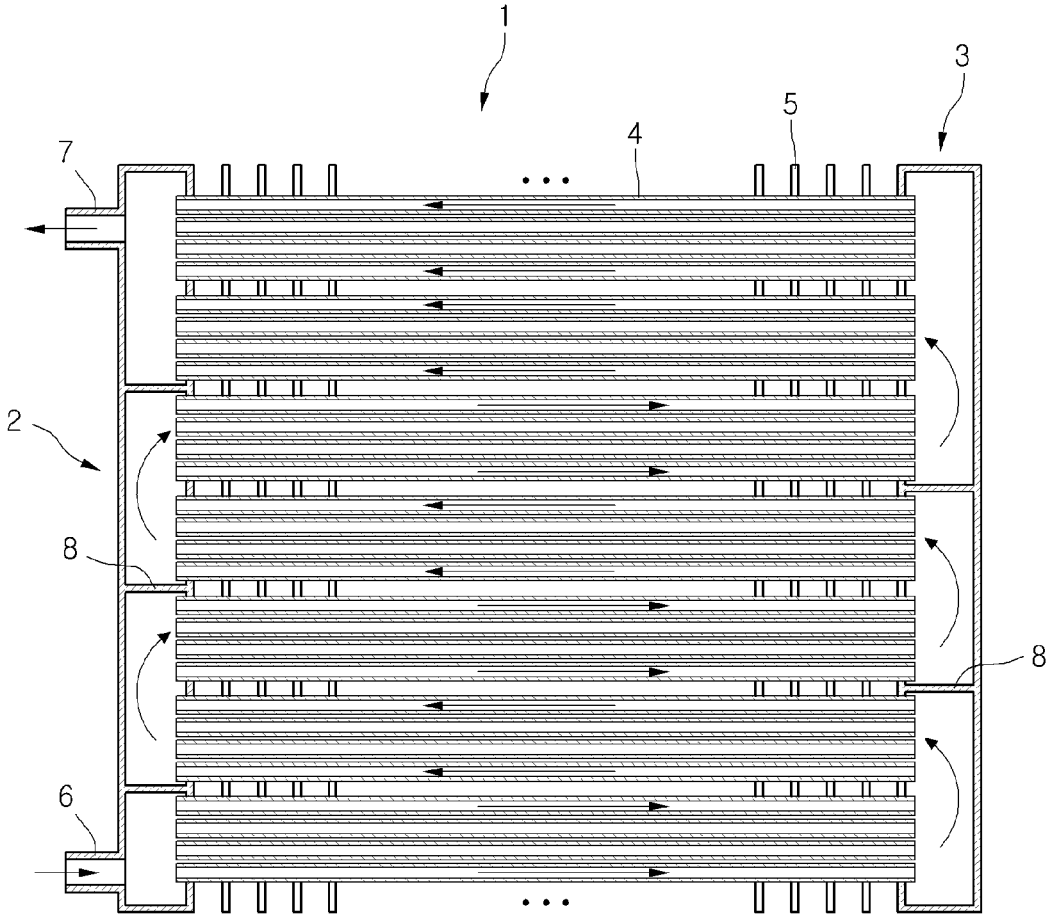
FIG. 16 is a view of a heat exchanger according to a related art.

FIG. 13 is a front view of a heat exchanger according to a fourth embodiment, FIG. 14 is a side view of the heat exchanger according to the fourth embodiment, and FIG. 15 is a perspective view of an inflow header according to the fourth embodiment.

Referring to FIG. 3, a heat exchanger 10 according to a fourth embodiment includes headers 80 and 300 extending vertically or horizontally by a predetermined length, a plurality of flat tubes 20 coupled to the headers 80 and 300 to extend vertically or horizontally, thereby serving as a refrigerant tube, and a plurality of heat-dissipation fins 30 arranged at a predetermined distance between the headers 80 and 300 and through which the flat tubes 20 pass. The headers 80 and 300 may be called "vertical type header" in that each of the headers 80 and 300 extends in a vertical direction.

In detail, the headers 80 and 300 include an entrance header 300 including a refrigerant inflow part 51 through which a refrigerant is introduced into the heat exchanger 10 and a refrigerant discharge part 55 through which the refrigerant heat-exchanged within the heat exchanger 10 is discharged and a return header 80 spaced upward or downward from the entrance header 300. The plurality of flat tubes 20 have one side ends coupled to the entrance header 300 and the other side ends coupled to the return header 80.

The entrance header 300 includes an inflow header 310 including the refrigerant inflow part 51, a discharge header 320 disposed on a side of the inflow header 310 and including the refrigerant discharge part 55, and a header partition part 330 disposed between the inflow header 310 and the discharge header 320 to partition the headers.

The return header 80 includes an inflow header 81 through which a refrigerant is introduced from the flat tubes 20, a discharge header 82 disposed on a side of the inflow header 81, and a header partition part 85 partitioning the inflow header 81 from the discharge header 82. A through hole 86 through which a refrigerant passes is defined in the header partition part 85.

The refrigerant introduced into the return header 80 flows into the discharge header 82 through the through hole 86, and the refrigerant within the discharge header 82 flows into the flat tubes 20.

The flat tubes 20 are arranged in two rows. The refrigerant introduced into the inflow header 310 through the refrigerant inflow part 51 is introduced into first flat tubes of the flat tubes 20 arranged in two rows. Here, the refrigerant may be branched and introduced into the plurality of first flat tubes.

The refrigerant flowing into the first flat tubes is introduced into the entrance header 80. Also, the refrigerant flows into a plurality of second flat tubes of the flat tubes 20 arranged in two rows via the inflow header 81 and the discharge header 82. The refrigerant flowing into the plurality of second flat tubes may be mixed with each other in the entrance header 300 and then be discharged to the outside through the refrigerant discharge part 55.

A guide device for distributing a refrigerant is provided in the entrance header 300. In detail, the guide device may be disposed inside the inflow header 310 for guiding a flow of a refrigerant introduced into the heat exchanger.

In detail, the inflow header 310 includes a header body 311 including a tube coupling part 312 coupled to the flat tubes 20, a header cover 318 coupled to a side of the header body 311, and a guide device disposed in a space between the header body 311 and the header cover 318.

The guide device includes a partition part 314 partitioning an inner space of the inflow header 310, a plurality of guide parts 315 extending from the partition part 314 in one direction to branch a refrigerant, and a plurality of partition wall 313 extending from the partition part 314 in the other direction to guide a refrigerant from the guide device into the flat tubes 20. Here, the one direction is opposite to the other direction. Also, a plurality of communication holes 316 are defined in the partition part 314.

Since dispositions of the partition part 314, the guide part 315, the partition wall 313, and the guide part 315 are similar to those described in the first and second embodiments, their detailed description will be omitted.

When the refrigerant introduced into the inflow header 310 through the refrigerant inflow part 51 reaches an inlet-side of the guide device, the refrigerant is branched into a plurality of passage by the guide parts 315 to flow in a direction of the partition wall 313 through the communication holes 316. Then, the refrigerant may be introduced into the plurality of first flat tubes through the tube coupling part 312.

As described above, in the heat exchanger including the horizontal type header, since the guide device is provided in the entrance header, and the refrigerant is branched by the plurality of guide parts to flow into the flat tubes, the refrigerant may be heat-exchanged in the state where the refrigerant is uniformly distributed.

Particularly, when the heat exchanger 10 serves as the evaporator, the initial refrigerant introduced into the heat exchanger 10 may be a two-phase refrigerant having a low dryness degree or a liquid refrigerant. Also, the refrigerant just discharged through the heat exchanger 10 after the refrigerant is heat-exchanged within the heat exchanger 10 may be a two-phase refrigerant having a high dryness degree or a gaseous refrigerant.

Thus, when the guide device is provided in the inflow header of the heat exchanger according to the current embodiment, since the liquid refrigerant or the two-phase refrigerant having the low dryness degree is efficiently distributed to flow into the flat tubes, the heat exchange performance in the flat tubes may be improved.

According to the proposed embodiments, the guide device may be provided in the header to partition the inner space of the header into the plurality of flow spaces. Thus, since the refrigerant is distributed into the plurality of flow spaces while flowing along the guide device, it may prevent the refrigerant from being concentrated into one space within the header.

Also, since the refrigerant is distributed into each of the flow spaces in the state where the liquid and gases refrigerants are adequately mixed with each other, the two-phase refrigerant may be easily introduced into each of the flat tubes connected to the header 100.

Also, since the guide device extends along a flow direction of the refrigerant, flow resistance of the refrigerant may not occur.

Also, since the guide device is gradually inclined outward from a center line of the header, the refrigerant (particularly, the liquid refrigerant) may be uniformly spread into the flow spaces within the header to flow into the header.

Also, since the plurality of communication holes are define din the partition part of the guide device and horizontally spaced apart from each other with respect to the flow direction of the refrigerant, the refrigerant within each of the flow spaces may be effectively introduced into the flat tubes through the communication holes.

Also, since the partition wall is provided in the guide device to prevent the refrigerant passing through the communication holes to continuously flow along the header, the refrigerant may be easily guided into the flat tubes.

Therefore, since the refrigerant is uniformly distributed into the plurality of flat tubes, heat exchange efficiency between the refrigerant and the surrounding air may be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger comprising:

a plurality of flat tubes in which a refrigerant flows;

a heat dissipation-fin in which the plurality of flat tubes are inserted and through which the refrigerant and a fluid are heat-exchanged with each other;

a first header including a refrigerant inflow part through which a refrigerant is introduced into the heat exchanger and a refrigerant discharge part through which the refrigerant heat-exchanged within heat exchanger is discharged;

a second header spaced apart from the first header; and a guide device disposed within the second header to route the refrigerant into a plurality of passages corresponding to the plurality of refrigerant, wherein the first header and the second header are extending vertically by a predetermined length, wherein the plurality of flat tubes are coupled to the first header and the second header to extend horizontally, wherein an end of one side of each of plurality of flat tubes is coupled to the first header, and an end of the other side of each of the plurality of flat tubes is coupled to the second header, wherein the refrigerant inflow part is disposed in a lower portion of the first header, and the refrigerant discharge part is disposed in an upper portion of the first header, wherein the guide device is disposed on a refrigerant channel closer to the refrigerant discharge part than to the refrigerant inflow part, the guide device being disposed at a position corresponding to the refrigerant discharge part, wherein the guide device comprises:

a plurality of guide parts distributing the refrigerant into a plurality of flow spaces, and a partition part coupled to a side of the plurality of guide parts, the partition part having a plurality of communication holes through which the refrigerant flowing into the plurality of flow spaces flows into the flat tubes.

2. The heat exchanger according to claim 1, wherein the guide device further comprises a plurality of partition walls extending from the partition part toward the flat tubes to guide the refrigerant passing through the communication holes into the flat tubes.

3. The heat exchanger according to claim 2, wherein the first header and the second header each comprise a tube coupling part to which the flat tubes are coupled, and wherein the same number of tube coupling parts are disposed between the each of the plurality of partition walls and an adjacent partition wall.

4. The heat exchanger according to claim 1, wherein a guide inflow part through which the refrigerant is introduced into the guide part is disposed in a side of the guide part, and a distance between the communication hole defined in one flow space of the plurality of flow spaces and the guide inflow part is different from that between the communication hole defined in another flow space of the plurality of flow spaces and the guide inflow part.

* * * * *